US008726569B2

(12) United States Patent
Weder et al.

(10) Patent No.: US 8,726,569 B2
(45) Date of Patent: May 20, 2014

(54) METHOD OF COVERING A POT WITH A FLORAL SLEEVE

(71) Applicant: Wanda M. Weder and William F. Straeter, not individually but solely as Trustees of The Family Trust, U/T/A, Highland, IL (US)

(72) Inventors: Donald E. Weder, Highland, IL (US); Joseph G. Straeter, Bradenton, FL (US); Michael R. Klemme, Maryville, IL (US)

(73) Assignee: Wanda M. Weder and William F. Straeter, Highland, IL (US), not individually but solely as Trustees of The Family Trust U/T/A dated Dec. 8, 1995

( * ) Notice: Subject to any disclaimer, the term of this patent is extended or adjusted under 35 U.S.C. 154(b) by 0 days.

(21) Appl. No.: 13/678,297

(22) Filed: Nov. 15, 2012

(65) Prior Publication Data

US 2013/0074407 A1 Mar. 28, 2013

Related U.S. Application Data

(63) Continuation of application No. 13/454,548, filed on Apr. 24, 2012, now abandoned, which is a continuation of application No. 13/414,117, filed on Mar. 7, 2012, now abandoned, which is a continuation of application No. 13/167,009, filed on Jun. 23, 2011, now abandoned, which is a continuation of application No. 12/984,985, filed on Jan. 5, 2011, now abandoned, which is a continuation of application No. 12/849,367, filed on Aug. 3, 2010, now abandoned, which is a continuation of application No. 12/793,399, filed on Jun. 3, 2010, now abandoned, which is a continuation of application No. 12/217,731, filed on Jul. 8, 2008, now abandoned, which is a continuation of application No. 11/651,763, filed on Jan. 10, 2007, now abandoned, which is a continuation of application No. 11/007,146, filed on Dec. 8, 2004, now abandoned, which is a continuation of application No. 10/636,521, filed on Aug. 6, 2003, now abandoned, which is a continuation-in-part of application No. 10/135,334, filed on Apr. 25, 2002, now abandoned, which is a continuation of application No. 09/972,499, filed on Oct. 5, 2001, now abandoned.

(51) Int. Cl.
*A01G 9/02* (2006.01)
*A01G 25/00* (2006.01)

(52) U.S. Cl.
USPC ..... 47/66.7; 47/79

(58) Field of Classification Search
USPC ..... 47/66.7, 72, 65.7, 65.8, 66.3, 66.4
See application file for complete search history.

(56) References Cited

U.S. PATENT DOCUMENTS 524,219 A 8/1894 Schmidt
732,889 A 7/1903 Paver (Continued)

FOREIGN PATENT DOCUMENTS

AU 4231978 6/1979
BE 654427 2/1965

(Continued)

OTHER PUBLICATIONS

Speed Cover Brochure, "The Simple Solution for Those Peak Volume Periods", Highland Supply Corporation, © 1989. 4 pages.

(Continued)

*Primary Examiner* — Monica Williams
(74) *Attorney, Agent, or Firm* — Dunlap Codding PC

(57) ABSTRACT

A floral sleeve having a body and an insert or extension attached thereto is used to cover a pot. The sleeve may have a detachable upper portion for enclosing a floral grouping disposed within the pot.

21 Claims, 6 Drawing Sheets

(56) References Cited

U.S. PATENT DOCUMENTS

| | | | |
|---|---|---|---|
| 950,785 | A | 3/1910 | Pene |
| 1,044,260 | A | 11/1912 | Schloss |
| 1,063,154 | A | 5/1913 | Bergen |
| 1,446,563 | A | 2/1923 | Hughes |
| 1,520,647 | A | 12/1924 | Hennigan |
| 1,525,015 | A | 2/1925 | Weeks |
| 1,610,652 | A | 12/1926 | Bouchard |
| 1,697,751 | A | 1/1929 | Blake |
| 1,794,212 | A | 1/1929 | Snyder |
| 1,811,574 | A | 3/1930 | Barrett |
| 1,863,216 | A | 6/1932 | Wordingham |
| 1,978,631 | A | 10/1934 | Herrlinger |
| 2,048,123 | A | 7/1936 | Howard |
| RE21,065 | E | 5/1939 | Copeman |
| 2,170,147 | A | 8/1939 | Lane |
| 2,200,111 | A | 5/1940 | Bensel |
| 2,278,673 | A | 4/1942 | Savada et al. |
| 2,302,259 | A | 11/1942 | Rothfuss |
| 2,323,287 | A | 7/1943 | Amberg |
| 2,355,559 | A | 8/1944 | Renner |
| 2,371,985 | A | 3/1945 | Freiberg |
| 2,411,328 | A | 11/1946 | MacNab |
| 2,510,120 | A | 6/1950 | Leander |
| 2,529,060 | A | 11/1950 | Trillich |
| 2,621,142 | A | 12/1952 | Wetherell |
| 2,648,487 | A | 8/1953 | Linda |
| 2,688,354 | A | 9/1954 | Berger |
| 2,688,914 | A | 9/1954 | Eckler |
| 2,774,187 | A | 12/1956 | Smithers |
| 2,822,287 | A | 2/1958 | Avery |
| 2,846,060 | A | 8/1958 | Yount |
| 2,850,842 | A | 9/1958 | Eubank, Jr. |
| 2,883,262 | A | 4/1959 | Borin |
| 2,989,828 | A | 6/1961 | Warp |
| 3,003,681 | A | 10/1961 | Orsini |
| 3,022,605 | A | 2/1962 | Reynolds |
| 3,080,680 | A | 3/1963 | Reynolds et al. |
| 3,094,810 | A | 6/1963 | Kalpin |
| 3,121,647 | A | 2/1964 | Harris et al. |
| 3,130,113 | A | 4/1964 | Silman |
| 3,172,796 | A | 3/1965 | Gülker |
| 3,271,922 | A | 9/1966 | Wallerstein et al. |
| 3,293,100 | A | 12/1966 | Questel |
| 3,316,675 | A | 5/1967 | Cartwright, Jr. |
| 3,322,325 | A | 5/1967 | Bush |
| 3,357,152 | A | 12/1967 | Geigel |
| 3,375,607 | A | 4/1968 | Melvoid |
| 3,376,666 | A | 4/1968 | Leonard |
| 3,380,646 | A | 4/1968 | Doyen et al. |
| 3,405,863 | A | 10/1968 | Kugler |
| 3,431,706 | A | 3/1969 | Stuck |
| 3,508,372 | A | 4/1970 | Wallerstein et al. |
| 3,510,054 | A | 5/1970 | Sanni et al. |
| 3,512,700 | A | 5/1970 | Evans et al. |
| 3,550,318 | A | 12/1970 | Remke et al. |
| 3,552,059 | A | 1/1971 | Moore |
| 3,554,434 | A | 1/1971 | Anderson |
| 3,556,389 | A | 1/1971 | Gregoire |
| 3,557,516 | A | 1/1971 | Brandt |
| 3,613,309 | A | 10/1971 | Coburn |
| 3,620,366 | A | 11/1971 | Parkinson |
| 3,681,105 | A | 8/1972 | Milutin et al. |
| 3,739,522 | A | 6/1973 | Greenbaum |
| 3,767,104 | A | 10/1973 | Bachman et al. |
| 3,793,799 | A | 2/1974 | Howe et al. |
| 3,804,322 | A | 4/1974 | Ericson |
| 3,869,828 | A | 3/1975 | Matsumoto |
| 3,872,621 | A | 3/1975 | Greenbaum |
| 3,888,443 | A | 6/1975 | Flanigen |
| 3,962,503 | A | 6/1976 | Crawford |
| 4,043,077 | A | 8/1977 | Stonehocker |
| 4,054,697 | A | 10/1977 | Reed et al. |
| 4,091,925 | A | 5/1978 | Griffo et al. |
| 4,113,100 | A | 9/1978 | Soja et al. |
| 4,118,890 | A | 10/1978 | Shore |
| 4,149,339 | A | 4/1979 | Hall et al. |
| 4,170,618 | A | 10/1979 | Adams |
| 4,189,868 | A | 2/1980 | Tymchuck et al. |
| 4,216,620 | A | 8/1980 | Weder et al. |
| 4,248,347 | A | 2/1981 | Trimbee |
| 4,258,501 | A | 3/1981 | Brown |
| D259,333 | S | 5/1981 | Charbonneau |
| 4,265,049 | A | 5/1981 | Gorewitz |
| 4,280,314 | A | 7/1981 | Stuck |
| 4,297,811 | A | 11/1981 | Weder |
| 4,299,056 | A | 11/1981 | Towning |
| 4,333,267 | A | 6/1982 | Witte |
| 4,347,686 | A | 9/1982 | Wood |
| 4,380,564 | A | 4/1983 | Cancio et al. |
| 4,400,910 | A | 8/1983 | Koudstall et al. |
| 4,413,725 | A | 11/1983 | Bruno et al. |
| 4,508,223 | A | 4/1985 | Catrambone |
| D279,279 | S | 6/1985 | Wagner |
| 4,546,875 | A | 10/1985 | Zweber |
| 4,570,423 | A | 2/1986 | DeLong |
| 4,621,733 | A | 11/1986 | Harris |
| 4,640,079 | A | 2/1987 | Stuck |
| 4,674,972 | A | 6/1987 | Wagner |
| 4,692,111 | A | 9/1987 | Wagner |
| 4,717,262 | A | 1/1988 | Roen et al. |
| 4,733,521 | A | 3/1988 | Weder et al. |
| 4,765,464 | A | 8/1988 | Ristvedt |
| 4,771,573 | A | 9/1988 | Stengel |
| 4,773,182 | A | 9/1988 | Weder et al. |
| 4,801,014 | A | 1/1989 | Meadows |
| 4,810,109 | A | 3/1989 | Castel |
| 4,835,834 | A | 6/1989 | Weder |
| D301,991 | S | 7/1989 | Van Sant |
| D304,317 | S | 10/1989 | Wagner |
| 4,900,390 | A | 2/1990 | Colton et al. |
| 4,918,861 | A | 4/1990 | Carpenter |
| 4,941,572 | A | 7/1990 | Harris |
| 4,946,290 | A | 8/1990 | Matyja |
| 4,980,209 | A | 12/1990 | Hill |
| 4,989,396 | A | 2/1991 | Weder et al. |
| D315,700 | S | 3/1991 | Stephens |
| 5,073,161 | A | 12/1991 | Weder et al. |
| 5,074,675 | A | 12/1991 | Osgood |
| 5,076,011 | A | 12/1991 | Stehouwer |
| 5,105,599 | A | 4/1992 | Weder |
| 5,111,638 | A | 5/1992 | Weder |
| 5,117,584 | A | 6/1992 | Ottenwalder et al. |
| 5,120,382 | A | 6/1992 | Weder |
| 5,152,100 | A | 10/1992 | Weder et al. |
| 5,181,364 | A | 1/1993 | Weder |
| D335,105 | S | 4/1993 | Ottenwalder et al. |
| 5,199,242 | A | 4/1993 | Weder et al. |
| 5,205,108 | A | 4/1993 | Weder et al. |
| 5,228,234 | A | 7/1993 | de Klerk et al. |
| 5,235,782 | A | 8/1993 | Landau |
| 5,239,775 | A | 8/1993 | Landau |
| 5,241,783 | A | 9/1993 | Krueger |
| 5,249,407 | A | 10/1993 | Stuck |
| 5,259,106 | A | 11/1993 | Weder et al. |
| 5,307,606 | A | 5/1994 | Weder |
| 5,315,785 | A | 5/1994 | Avôt et al. |
| 5,350,240 | A | 9/1994 | Billman et al. |
| 5,353,575 | A | 10/1994 | Stepanek |
| 5,361,482 | A | 11/1994 | Weder et al. |
| 5,363,592 | A | 11/1994 | Weder et al. |
| 5,388,695 | A | 2/1995 | Gilbert |
| 5,428,939 | A | 7/1995 | Weder et al. |
| 5,443,670 | A | 8/1995 | Landau |
| D362,829 | S | 10/1995 | Wagner |
| 5,493,809 | A | 2/1996 | Weder et al. |
| D368,025 | S | 3/1996 | Sekerak et al. |
| 5,496,251 | A | 3/1996 | Cheng |
| 5,496,252 | A | 3/1996 | Gilbert |
| 5,526,932 | A | 6/1996 | Weder |
| 5,551,570 | A | 9/1996 | Shaffer et al. |
| 5,572,849 | A | 11/1996 | Weder et al. |
| 5,572,851 | A | 11/1996 | Weder |
| 5,575,107 | A | 11/1996 | Doerr |
| 5,575,133 | A | 11/1996 | Weder et al. |

(56) References Cited

U.S. PATENT DOCUMENTS

| | | | |
|---|---|---|---|
| 5,617,703 | A | 4/1997 | Weder |
| 5,624,320 | A | 4/1997 | Martinez |
| 5,625,979 | A | 5/1997 | Weder |
| 5,647,168 | A | 7/1997 | Gilbert |
| 5,647,193 | A | 7/1997 | Weder et al. |
| 5,706,604 | A | 1/1998 | Yogi |
| 5,706,605 | A | 1/1998 | Alcazar |
| 5,715,944 | A | 2/1998 | Windisch |
| 5,735,103 | A | 4/1998 | Weder |
| 5,758,472 | A | 6/1998 | Weder |
| 5,813,194 | A | 9/1998 | Weder |
| D399,787 | S | 10/1998 | Wagner |
| D399,788 | S | 10/1998 | Wagner |
| D404,684 | S | 1/1999 | Shea |
| D409,057 | S | 5/1999 | Wagner |
| 5,924,241 | A | 7/1999 | Hodge |
| 5,941,020 | A | 8/1999 | Weder |
| D413,547 | S | 9/1999 | Wagner |
| 5,966,866 | A | 10/1999 | Ferguson |
| 5,974,730 | A | 11/1999 | Chien |
| D419,436 | S | 1/2000 | Celtorius et al. |
| D419,439 | S | 1/2000 | Markovsky et al. |
| 6,009,687 | A | 1/2000 | Weder |
| 6,047,524 | A | 4/2000 | Weder |
| D424,972 | S | 5/2000 | Ferguson |
| 6,071,445 | A | 6/2000 | Wagner |
| D428,827 | S | 8/2000 | Wagner |
| 6,098,336 | A | 8/2000 | Ferguson |
| D431,495 | S | 10/2000 | Wagner |
| 6,129,208 | A | 10/2000 | Ferguson |
| 6,129,209 | A | 10/2000 | Tchira |
| 6,141,906 | A | 11/2000 | Weder |
| D435,481 | S | 12/2000 | Wagner |
| 6,182,395 | B1 | 2/2001 | Weder |
| 6,183,590 | B1 | 2/2001 | Weder |
| 6,185,904 | B1 | 2/2001 | Weder et al. |
| 6,230,441 | B1 | 5/2001 | Weder et al. |
| D448,130 | S | 9/2001 | Wagner |
| 6,286,255 | B1 | 9/2001 | Weder et al. |
| 6,286,256 | B1 | 9/2001 | Weder |
| 6,298,601 | B1 | 10/2001 | Weder et al. |
| 6,341,446 | B2 | 1/2002 | Weder et al. |
| 6,345,467 | B1 | 2/2002 | Weder |
| 6,360,485 | B1 | 3/2002 | Weder et al. |
| 6,385,905 | B1 | 5/2002 | Weder |
| 6,418,698 | B1 | 7/2002 | Weder et al. |
| 6,425,203 | B1 | 7/2002 | Weder et al. |
| 6,453,611 | B1 | 9/2002 | Weder et al. |
| 6,477,804 | B2 | 11/2002 | Weder et al. |
| 6,523,305 | B2 | 2/2003 | Weder et al. |
| 6,539,666 | B2 | 4/2003 | Weder et al. |
| 6,546,669 | B2 | 4/2003 | Weder et al. |
| 6,571,536 | B2 | 6/2003 | Weder et al. |
| 6,598,341 | B2 | 7/2003 | Weder |
| 6,601,367 | B1 | 8/2003 | Weder et al. |
| 6,655,086 | B2 | 12/2003 | Weder et al. |
| 6,662,495 | B2 | 12/2003 | Weder et al. |
| 6,871,447 | B2 | 3/2005 | Weder et al. |
| 2008/0229660 | A1 | 9/2008 | Weder |
| 2009/0044447 | A1 | 2/2009 | Weder et al. |
| 2010/0257783 | A1 | 10/2010 | Weder et al. |
| 2012/0240465 | A1 | 9/2012 | Weder |

FOREIGN PATENT DOCUMENTS

| | | |
|---|---|---|
| CH | 560532 | 4/1975 |
| DE | 345464 | 12/1921 |
| DE | 513971 | 12/1930 |
| DE | 1962947 | 6/1971 |
| DE | 2060812 | 11/1971 |
| DE | 2748626 | 5/1979 |
| DE | 3445799 | 6/1986 |
| DE | 3829281 | 5/1989 |
| DE | 3911847 | 10/1990 |
| DE | 1166692 | 3/1994 |
| EP | 0050990 | 5/1982 |
| EP | 0791543 | 8/1997 |
| FR | 1376047 | 9/1964 |
| FR | 2036163 | 12/1970 |
| FR | 2137325 | 12/1972 |
| FR | 2272914 | 12/1975 |
| FR | 2489126 | 3/1982 |
| FR | 2567068 | 1/1986 |
| FR | 2603159 | 3/1988 |
| FR | 2610604 | 8/1988 |
| FR | 2619698 | 3/1989 |
| FR | 2651663 | 3/1991 |
| GB | 5605 | 0/1885 |
| GB | 15550 | 0/1900 |
| GB | 1204647 | 9/1970 |
| GB | 2055031 | 2/1981 |
| GB | 2056410 | 3/1981 |
| GB | 2074542 | 11/1981 |
| GB | 2094123 | 9/1982 |
| GB | 2128083 | 4/1984 |
| GB | 2203127 | 10/1988 |
| GB | 2212136 | 7/1989 |
| GB | 2252708 | 8/1992 |
| IT | 224507 | 4/1996 |
| JP | 5-42958 | 2/1993 |
| JP | 6-127555 | 5/1994 |
| JP | 8-19334 | 1/1996 |
| NL | 8301709 | 12/1984 |
| NL | 1000658 | 1/1996 |
| WO | 9315979 | 8/1993 |
| WO | 9712819 | 4/1997 |

OTHER PUBLICATIONS

"Speed Sheets and Speed Rolls" Brochure, Highland Supply Corporation, © 1990. 2 pages.
"Color Them Happy with Highlander Products" © 1992. 1 page.
"Costa Keeps the Christmas Spirit", Supermarket Floral, Sep. 15, 1992. 2 pages.
"Super Seller", Supermarket Floral, Sep. 15, 1992. 2 pages.
"Halloween", Link Magazine, Sep. 1992. 2 pages.
"Now More Than Ever", Supermarket Floral, Sep. 15, 1992. 2 pages.
Le Plant Sac Advertisement, published prior to Sep. 26, 1987. 1 page.
"A World of Cut Flower and Pot Plant Packaging" Brochure, Klerk's Plastic Products Manufacturing, Inc., published prior to Mar. 31, 1994, 6 pages.
Chantler & Chantler brochure showing Zipper Sleeve™ and Florasheet®, published prior to Mar. 31, 1994, 2 pages.
"Stand Alone Plastic Bagmaking" brochure, AMI, Atlanta, GA, Feb. 15, 1996, 2 pages.
"Foil Jackets" brochure, Custom Medallion, Inc., Dec. 1996, 2 pages.
"Derwent Abstract" of FR 2610604A. It is noted that the abstract is an incorrect English translation of the contents of the French patent. The French patent does not enable or disclose adhesively attaching the covering to the container. 1988. 1 page.
"Silver Linings" Brochure, Affinity Diversified Industries, Inc., 1986. The Silver Linings brochure shows a floral sleeve with a closed bottom. The brochure shows, in one embodiment, a vase with flowers inside a "cut flower" sleeve with the sleeve tied with a ribbon about the neck of the vase. 2 pages.
"Special Occasion Printed Highlophane Bags" Brochure, Highland Supply Corporation, 1990, 2 pages.
"Creative Packaging" Brochure, John Henry Company, Sep. 1992. 4 pages.
"Make Highlander Your Headquarters" Brochure, Highland Supply Corporation, 1991. 2 pages.

METHOD OF COVERING A POT WITH A FLORAL SLEEVE

CROSS REFERENCE TO RELATED APPLICATIONS

The entire contents of each of the patents and patent applications listed below are expressly incorporated herein by reference: U.S. Ser. No. 13/454,548, filed Apr. 24, 2012; U.S. Ser. No. 13/414,117, filed Mar. 7, 2012; U.S. Ser. No. 13/167,009, filed Jun. 23, 2011; U.S. Ser. No. 12/984,985, filed Jan. 5, 2011; U.S. Ser. No. 12/849,367, filed Aug. 3, 2010; U.S. Ser. No. 12/793,399, filed Jun. 3, 2010; U.S. Ser. No. 12/217,731, filed Jul. 8, 2008; U.S. Ser. No. 11/651,763, filed Jan. 10, 2007; U.S. Ser. No. 11/007,146, filed Dec. 8, 2004; U.S. Ser. No. 10/636,521, filed Aug. 6, 2003; U.S. Ser. No. 10/135,334, filed Apr. 25, 2002; U.S. Ser. No. 09/972,499, filed Oct. 5, 2001; U.S. Ser. No. 10/423,497, filed Apr. 24, 2003; U.S. Ser. No. 09/954,665, filed Sep. 18, 2001; U.S. Ser. No. 09/612,122, filed Jul. 7, 2000; U.S. Ser. No. 09/466,705, filed on Dec. 17, 1999; U.S. Ser. No. 09/062,329, filed Apr. 17, 1998; U.S. Ser. No. 08/749,626, filed Nov. 18, 1996; U.S. Ser. No. 08/458,327, filed Jun. 2, 1995; U.S. Ser. No. 08/386,859, filed Feb. 10, 1995; U.S. Ser. No. 08/237,078, filed May 3, 1994; and U.S. Ser. No. 08/220,852, filed Mar. 31, 1994.

BACKGROUND OF THE PRESENTLY DISCLOSED AND CLAIMED INVENTIVE CONCEPT(S)

The presently disclosed and claimed inventive concept(s) generally relates to sleeves, and, more particularly, to floral sleeves used to contain floral groupings and/or media, or used to wrap flower pots containing floral groupings and/or media containing floral grouping, and methods of using same.

U.S. Pat. Nos. 5,595,022; 5,615,535; 5,740,657; 5,816,023; 5,687,845; 5,810,169; 5,944,187 and 6,152,301, contain subject matter which may be relevant to the present application. The disclosures of each of the above-mentioned patents are hereby expressly incorporated herein by reference.

DETAILED DESCRIPTION OF THE INVENTIVE CONCEPT(S)

Figure 1:
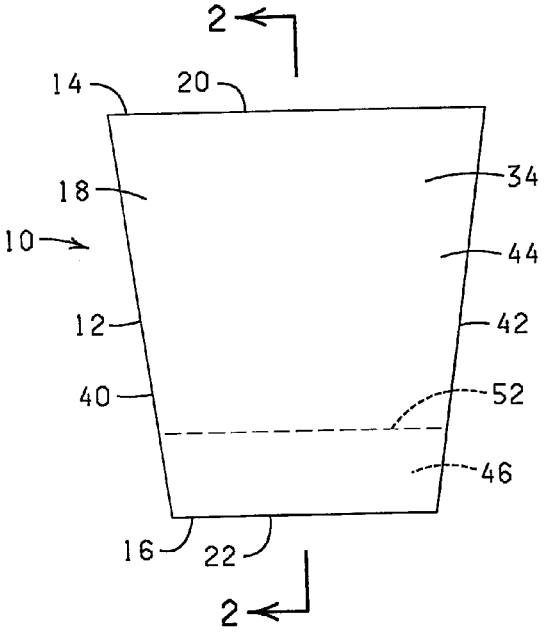
FIG. 1 is an elevational view of a floral sleeve constructed in accordance with the presently disclosed and claimed inventive concept(s).
Figure 2:
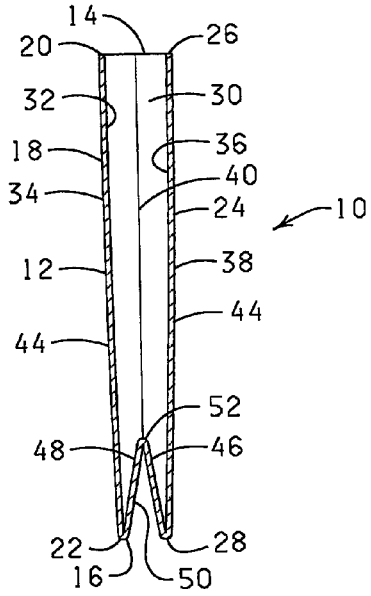
FIG. 2 is a cross-sectional view of the floral sleeve of FIG. 1 taken along line 2-2 thereof.
Figure 3:
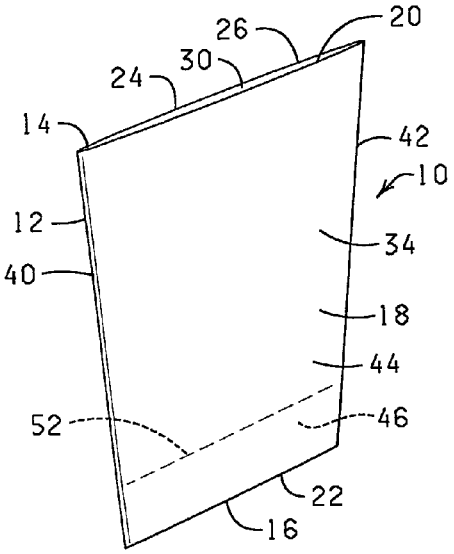
FIG. 3 is a perspective view of the floral sleeve of FIG. 1.

The presently disclosed and claimed inventive concept(s) contemplates in a preferred version a preformed flexible floral sleeve having a tubular shape for covering a flower pot having an upper end, a lower end, and an outer peripheral surface. The preformed flexible floral sleeve comprises a body which may have a skirt portion and which may have a straight or non-linear upper edge. The preformed flexible floral sleeve may further comprise a detachable upper portion which may be sized to surround and encompass a floral grouping. The upper portion when present may be detachable via a detaching element, such as but not by way of limitation, perforations, tear strips, weakened areas, or zippers. The upper portion may have one or more apertures for serving as a handle or for enabling the preformed flexible floral sleeve to be supported from a support device.

The preformed flexible floral sleeve (also referred to herein as a floral sleeve, a sleeve or a sleeve cover) may form part of a plant package when used in conjunction with a flower pot disposed within an interior space of the body of the floral sleeve, the flower pot preferably having a floral grouping disposed therein, and wherein the flower pot is substantially surrounded and encompassed by the body and the floral grouping is at least partially surrounded and encompassed and may be entirely enclosed by the upper portion when it forms a part of the floral sleeve.

Also, the body may comprise an adhesive or cohesive bonding material disposed on an inner surface thereof for bondingly connecting the body to a flower pot disposed therein. Alternately, a bonding material may be disposed on an outer surface of the body for securing a crimped portion having a plurality of crimped folds formed in the body.

These embodiments and others of the presently disclosed and claimed inventive concept(s) are now described in more detail below. It will be appreciated that the examples provided herein are not intended to limit the scope and extent of the presently disclosed and claimed inventive concept(s) but are only intended to exemplify various embodiments of the presently disclosed and claimed inventive concept(s) contemplated herein.

Referring now to the drawings, shown in FIGS. 1-5 and designated therein by the general reference numeral 10 is a floral sleeve, also referred to herein simply as a sleeve. The floral sleeve 10 is initially in a substantially flattened state (FIGS. 1-3) and is openable to an opened condition (FIGS. 4-5) for containing and covering a flower pot. The floral sleeve 10 has a body 12 having an upper end 14, a lower end 16, a first panel 18 having a first upper edge 20 and a first lower edge 22 and a second panel 24 having a second upper edge 26 and a second lower edge 28 which is generally parallel and adjacent to the first lower edge 22. The body 12 has an interior space 30. The first panel 18 has an inner surface 32 and an outer surface 34. The second panel 24 has an inner surface 36 and an outer surface 38.

Figure 4:
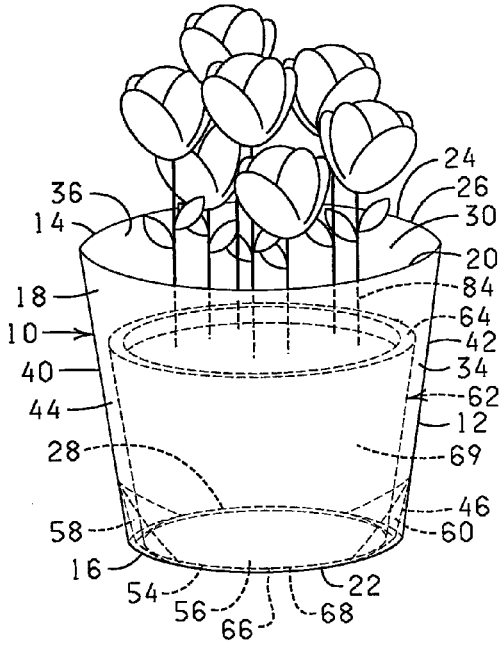
FIG. 4 is a perspective view of the floral sleeve of FIG. 1 in an opened condition and having a pot and floral grouping disposed therein.
Figure 5:
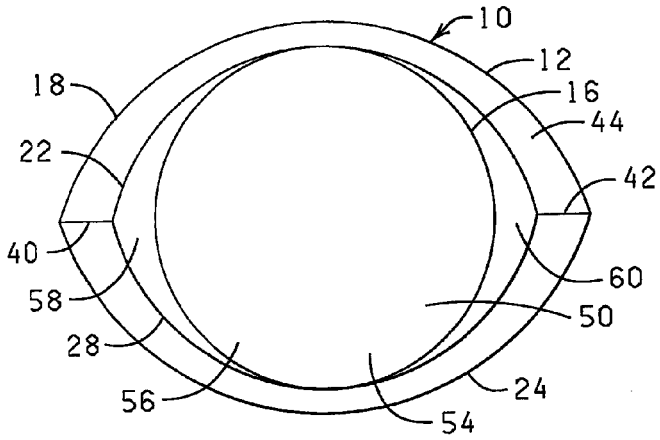
FIG. 5 is a bottom plan view of the opened floral sleeve of FIG. 4.

In the flattened condition, the first panel 18 and second panel 24 are positioned flatwise upon each other and are connected along a sealed left side edge 40 and a sealed right side edge 42 both of which extend from the upper end 14 to the lower end 16. The first panel 18 and second panel 24 together comprise a sidewall 44 of the body 12. The body 12 further comprises a gusset 46 extending inwardly into the interior space 30 from the first lower edge 22 and the second lower edge 28. The gusset 46 has an inner surface 48 exposed to the interior space 30 and an outer surface 50 exposed outwardly. The gusset 46 has an inner fold 52 which extends from the left side edge 40 to the right side edge 42. The body 12 preferably has a tapered shape in the flattened condition, wherein the body 12 is wider at the upper end 14 and narrower at the lower end 16, such that in the opened condition the floral sleeve 10 preferably has a frusto-conical shape (FIG. 4). As noted, the floral sleeve 10 preferably has a frusto-conical shape when opened, but may be cylindrical or may even have a rectangular shape when opened. This type of gusset has the utilitarian advantage over other gussets used in sleeves in the floral industry in that a decoration placed on the first panel 18 and/or on second panel 24 remains substantially undistorted by folds when the floral sleeve 10 (or other floral sleeves described herein) is used to cover a pot 62, thereby providing a more pleasing decorative appearance to the covered pot 62.

When the floral sleeve 10 is converted to an opened condition, the gusset 46 is unfolded to form a bottom 54 in the body 12. When the pot 62 is disposed within the interior space 30 and a bottom 68 of a lower end 66 of the pot 62 is disposed upon the bottom 54 of the body 12, the bottom 54 has three surface portions, including (1) a lower bottom surface 56 covering the bottom 68 of the pot 62, (2) a left side bottom surface 58 which extends upwardly from the lower bottom surface 56 and is disposed between the sidewall 44 of the body 12 and an outer peripheral surface 69 of the pot, and (3) a right side bottom surface 60 which extends upwardly from the lower bottom surface 56 and is disposed between the sidewall 44 of the body 12 and the outer peripheral surface 69 of the pot. In the opened condition of the floral sleeve 10, the bottom 54 of the body 12 is substantially completely concealed by a lower portion of the sidewall 44 of the body 12.

Figure 6:
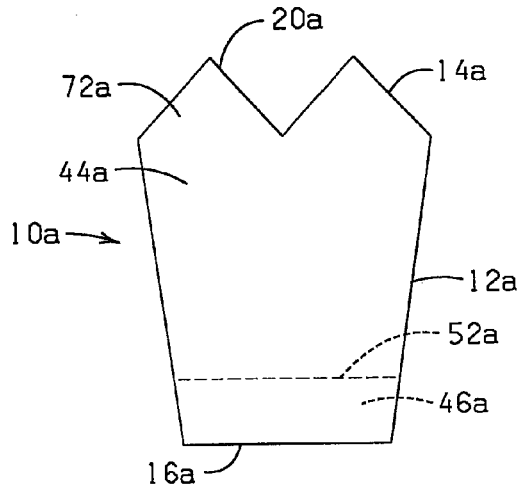
FIG. 6 is an elevational view of an alternate embodiment of the floral sleeve of the presently disclosed and claimed inventive concept(s).

Referring now to FIG. 6, another floral sleeve embodied in the presently disclosed and claimed inventive concept(s) is designated therein by reference numeral 10*a*. Floral sleeve 10*a* has a body 12*a*, an upper end 14*a*, a lower end 16*a*, a skirt upper edge 20*a*, a sidewall 44*a*, a gusset 46*a*, and an inner gusset fold 52*a*. The skirt upper edge 20*a* is unsealed and can be opened for disposition of a pot. The floral sleeve 10*a* is essentially the same as floral sleeve 10 except the upper edge 20*a* has a non-linear (angular) pattern forming a skirt portion 72*a* in the body 12*a*. Generally, the skirt portion 72*a* is sized to extend a distance above an upper end 64 of the pot 62 (FIG. 4) when the pot 62 is disposed within the floral sleeve 10*a* when in the opened condition. Alternatively, the skirt portion 72*a* may be sized so that when the pot 62 is disposed therein, the upper edge 20*a* may be positioned partially or entirely below the upper end 64 of the pot 62.

Figure 7:
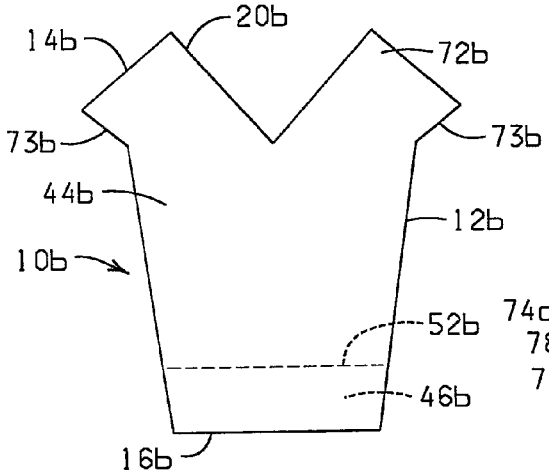
FIG. 7 is an elevational view of an alternate embodiment of the floral sleeve of the presently disclosed and claimed inventive concept(s).

Referring now to FIG. 7 another floral sleeve embodied in the presently disclosed and claimed inventive concept(s) is designated therein by reference numeral 10*b*. Floral sleeve 10*b* has a body 12*b*, an upper end 14*b*, a lower end 16*b*, an upper edge 20*b*, a sidewall 44*b*, a gusset 46*b*, and an inner gusset fold 52*b*. The floral sleeve 10*b* is essentially the same as floral sleeve 10*a* except the upper edge 20*b* has a skirt portion 72*b* which has an outwardly flared portion 73*b* extending beyond the body 12*b*. The skirt portion 72*b* is preferably sized to extend a distance above the upper end 64 of the pot 62 when the pot 62 is disposed within the floral sleeve 10*b* when in the opened condition but may alternatively be sized to be below the upper end 64 of the pot 62. The skirt upper edge 20*b*, and the outwardly flared portion 73*b* of the skirt portion 72*b* extending beyond the body 12*b* are unsealed.

Figure 8:
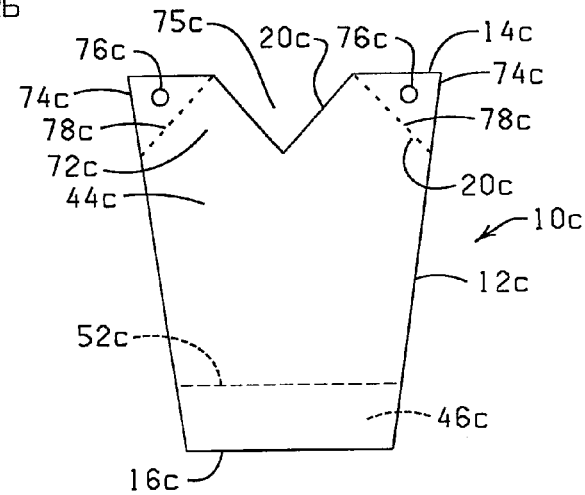
FIG. 8 is an elevational view of an alternate embodiment of the floral sleeve of the presently disclosed and claimed inventive concept(s).

Referring now to FIG. 8, a preferred floral sleeve embodiment of in the presently disclosed and claimed inventive concept(s) is designated therein by reference numeral 10*c*. Floral sleeve 10*c* has a body 12*c*, a skirt portion 72*c* in the body 12*c*, an upper end 14*c*, a lower end 16*c*, a skirt upper edge 20*c*, a sidewall 44*c*, a gusset 46*c*, and an inner gusset fold 52*c*. The floral sleeve 10*c* is essentially similar to floral sleeve 10*a* except the floral sleeve 10*c* further comprises a pair of upper support elements 74*c* preferably each having an aperture 76*c* and which are each detachable via a detaching element 78*c*. There is a gap or notch 75*c* between the upper support elements 74*c* which increases the ease with which the sleeve 10*c* can be opened and the pot 62 disposed therein by reducing excess material which could interfere with deposition of the pot 62 into the sleeve 10*c*. The apertures 76*c* serve to adapt each upper support element 74*c* to support the entire floral sleeve 10*c* from a support assembly such as a wicket, hanger, staple, pin, clip, hook, or rod, for example. For example, a plurality of sleeves 10*c* may be supported on a portable banding device, such as the banding device shown in U.S. Pat. No. 6,718,741, issued Apr. 13, 2004, entitled "METHOD AND APPARATUS FOR SECURING A DECORATIVE COVER ABOUT A FLOWER POT", the specification of which is expressly incorporated by reference herein in its entirety, which can be used manually or automatically to apply one of such sleeves 10*c* about a potted plant. As the sleeve 10*c* is removed, the upper support elements 74*c* remain behind on the portable banding device. In an alternative embodiment, a plurality of floral sleeves 10*c* may be provided in a pad, with the upper support element 74*c* of adjacent floral sleeves 10*c* connected together by an adhesive or cohesive bonding material, a staple, clip, or pin in a manner well known in the art. Preferably, the body 12*c* and skirt portion 72*c* of the floral sleeve 10*c* are detached from the upper support element 74*c* before the sleeve 10*c* is placed about the pot 62.

Figure 9:
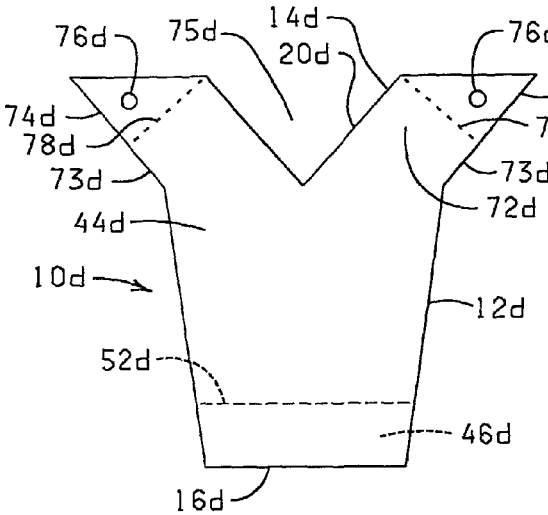
FIG. 9 is an elevational view of an alternate embodiment of the floral sleeve of the presently disclosed and claimed inventive concept(s).

Referring now to FIG. 9, another floral sleeve embodied in the presently disclosed and claimed inventive concept(s) is designated therein by reference numeral 10*d*. Floral sleeve 10*d* has a body 12*d*, a skirt portion 72*d* in the body 12*d*, an upper end 14*d*, a lower end 16*d*, a sidewall 44*d*, a skirt upper edge 20*d*, a gusset 46*d*, and an inner gusset fold 52*d*. The floral sleeve 10*d* is essentially similar to floral sleeve 10*c* in that the floral sleeve 10*d* comprises upper support elements 74*d* each preferably having at least one aperture 76*d* and which is detachable via a detaching element 78*d*. There is a gap or notch 75*d* between the upper support elements 74*d*. The apertures 76 serve to adapt each upper support element 74*d* to support the entire floral sleeve 10*d* from a support assembly as defined above. The skirt portion 72*d* has outwardly flared portions 73*d* which preferably are unsealed, as is the remainder of the upper edge 20*d*. In an alternative embodiment as described above, a plurality of floral sleeves 10*d* may be provided in a pad, with the upper support elements 74*d* of adjacent floral sleeves 10*d* connected together by an adhesive or cohesive bonding material or other attaching device in a manner well known in the art. Preferably, the body 12*d* and skirt portion 72*d* of the floral sleeve 10*d* are detached from the upper portion 74*d* before the sleeve 10*d* is placed about the pot 62.

Figure 10:
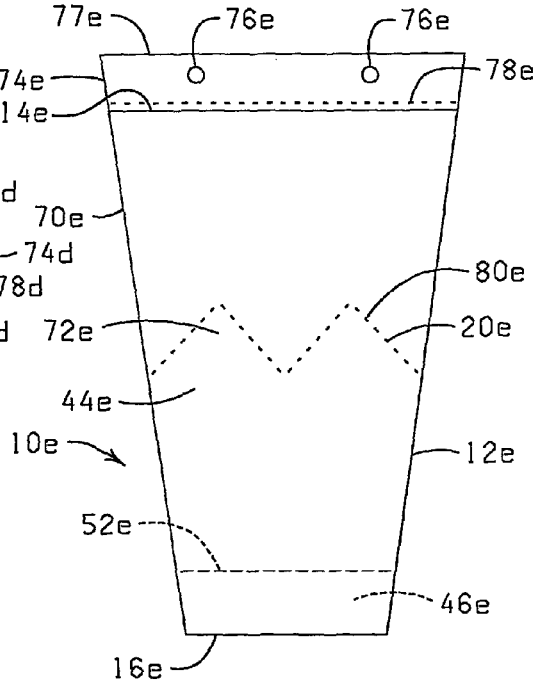
FIG. 10 is an elevational view of an alternate embodiment of the floral sleeve of the presently disclosed and claimed inventive concept(s).
Figure 11:
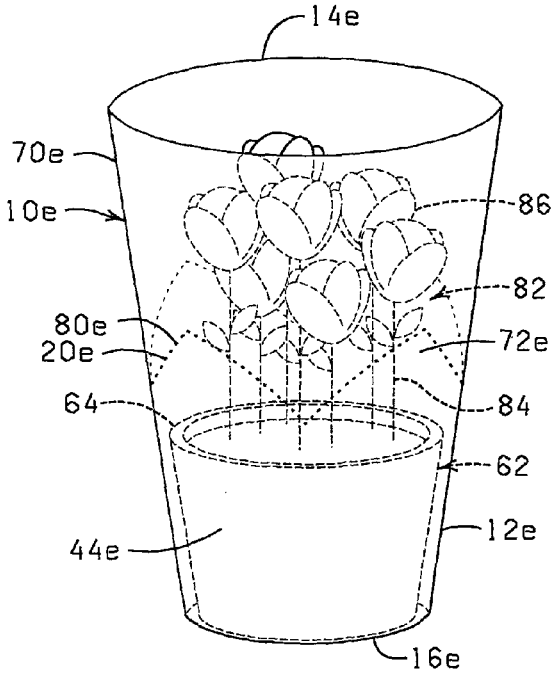
FIG. 11 is a perspective view of the floral sleeve of FIG. 10 having a pot and floral grouping disposed therein.

Referring now to FIGS. 10 and 11, another floral sleeve embodied in the presently disclosed and claimed inventive concept(s) is designated therein by reference numeral 10*e*. Floral sleeve 10*e* has a body 12*e*, a skirt portion 72*e* in the body 12*e*, an upper end 14*e*, a lower end 16*e*, a sidewall 44*e* in the body 12*e*, a gusset 46*e*, and an inner gusset fold 52*e*. The floral sleeve 10*e* further comprises an upper portion 70*e* and a support element 74*e* having apertures 76*e* and an upper edge 77*e* which is detachable from the upper portion 70*e* via a detaching element 78*e*. The apertures 76*e* are optional and serve to adapt the upper portion 70*e* to support the entire floral sleeve 10*e* from a support assembly as defined elsewhere herein. In an alternative embodiment, a plurality of floral sleeves 10*e* may be provided in a pad, with the upper portions 70*e* of adjacent floral sleeves 10*e* connected together by an adhesive or cohesive bonding material or other connecting device in a manner well known in the art.

The upper portion 70*e* is generally sized to surround and enclose a floral grouping 82 having a lower portion 84 and an upper portion 86 comprising blooms and/or foliage, which is disposed within the pot 62 when the pot 62 and floral grouping 82 therein is disposed within the opened floral sleeve 10*e*. The upper portion 70*e* can be detached from the body 12*e* via a detaching element 80*e* at some time after the floral sleeve 10*e* has been disposed about the pot 62 and floral grouping 82, for example after the pot 62 and floral grouping 82 therein have been shipped to a vendor, but may be detached at any time, either before or after the pot 62 and floral grouping 82 have been placed within the floral sleeve 10*e*. When the upper portion 70*e* is detached, the skirt portion 72*e* remains with the body 12*e* leaving a covering such as sleeve 10*a* disposed about the pot 62. The detaching element 80*e* leaves a skirt upper edge 20*e* on the skirt portion 72*e* in the body 12*e*. The skirt portion 72*e* preferably is sized to extend above the upper end 64 of the pot 62 when disposed within the floral sleeve 10*d* although the skirt upper edge 20*d* may be below the upper end 64 of the pot 62.

Figure 12:
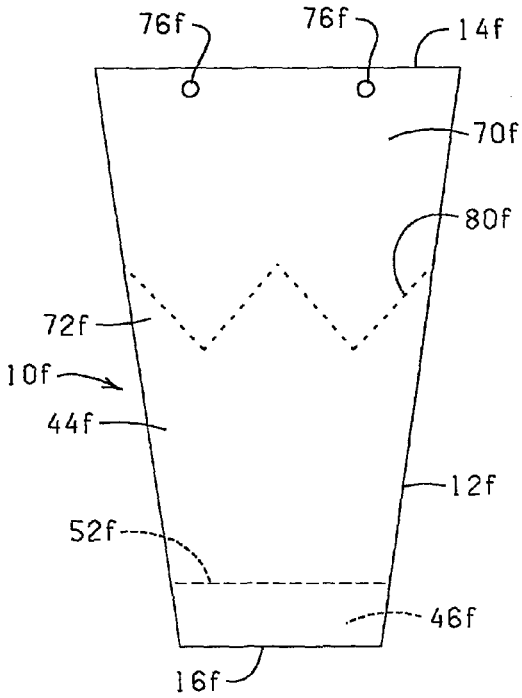
FIG. 12 is an elevational view of an alternate embodiment of the floral sleeve of the presently disclosed and claimed inventive concept(s).

Referring now to FIG. 12, another floral sleeve embodied in the presently disclosed and claimed inventive concept(s) is designated therein by reference numeral 10*f*. Floral sleeve 10*f* has a body 12*f*, a skirt portion 72*f*, an upper end 14*f*, a lower end 16*f*, a sidewall 44*f*, a gusset 46*f*, and an inner gusset fold 52*f*. The floral sleeve 10*f* is similar to floral sleeve 10*e* in that the floral sleeve 10*f* comprises an upper portion 70*f* having apertures 76*f* and which is detachable from the skirt portion 72*f* via a detaching element 80*f*. The apertures 76*f* are optional and serve to adapt the upper portion 70*f* to support the entire floral sleeve 10*f* from a support assembly such as described elsewhere herein. Sleeve 10*f* differs from sleeve 10*e* primarily in that sleeve 10*f* does not have a separate support element which is detachable from upper portion 70*f*. The detaching element 80*f* has an angular pattern such that when the upper portion 70*f* is detached from the body 12*f*, the skirt portion 72*f* is left on the body 12*f*. The skirt portion 72*f* preferably is sized to extend above the upper end 64 of the pot 62 when disposed within the floral sleeve 10*f*.

Figure 13:
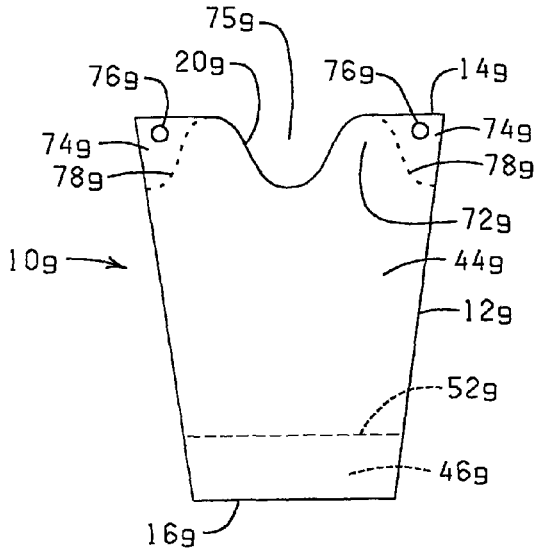
FIG. 13 is an elevational view of an alternate embodiment of the floral sleeve of the presently disclosed and claimed inventive concept(s).

Referring now to FIG. 13, another floral sleeve embodied in the presently disclosed and claimed inventive concept(s) is designated therein by reference numeral 10*g*. Floral sleeve 10*g* has a body 12*g* having a skirt portion 72*g*, an upper end 14*g*, a lower end 16*g*, a skirt upper edge 20*g*, a sidewall 44*g*, a gusset 46*g*, and an inner gusset fold 52*g*. The floral sleeve 10*g* is similar to floral sleeve 10*c* in that the floral sleeve 10*g* comprises upper support elements 74*g* and preferably having apertures 76*g* and which are detachable via detaching elements 78*g*. There is a gap or notch 75*g* between upper support elements 74*g*. The apertures 76*g* are optional and serve to adapt the upper support elements 74*g* to support the entire floral sleeve 10*g* from a support assembly as described elsewhere herein. In an alternative embodiment, a plurality of floral sleeves 10*g* may be provided in a pad, as described elsewhere herein.

The detaching element 78*g* and skirt upper edge 20*g* differ from detaching element 78*c* and upper skirt edge 20*c* of floral sleeve 10*c* in that detaching element 78*g* and upper skirt edge 20*g* have a curved non-linear pattern rather than an angular non-linear pattern, such that when the upper support elements 74*g* are detached from the body 12*g*, the skirt portion 72*g* is left with the curved upper edge 20*g*. The skirt portion 72*g* preferably is sized to extend above the upper end 64 of the pot 62 when disposed within the floral sleeve 10*g* but may be sized to be below the upper end 64 of the pot 62 in an alternate embodiment.

Figure 14:
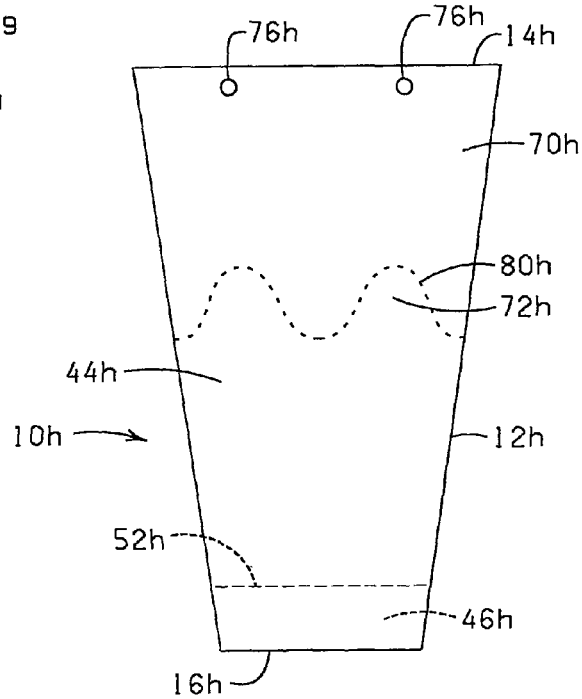
FIG. 14 is an elevational view of an alternate embodiment of the floral sleeve of the presently disclosed and claimed inventive concept(s).

Referring now to FIG. 14, another floral sleeve embodied in the presently disclosed and claimed inventive concept(s) is designated therein by reference numeral 10*h*. Floral sleeve 10*h* has a body 12*h*, an upper end 14*h*, a lower end 16*h*, a sidewall 44*h*, a gusset 46*h*, and an inner gusset fold 52*h*. The floral sleeve 10*h* is essentially similar to floral sleeve 10*f* in that the floral sleeve 10*h* comprises an upper portion 70*h* having apertures 76*h* and which is detachable from a skirt portion 72*h* via a detaching element 80*h*. The apertures 76*h* are optional and serve to adapt the upper portion 70*h* to support the entire floral sleeve 10*h* from a support assembly such as described elsewhere herein.

The upper portion 70*h* preferably is sized to surround and enclose the floral grouping 82 as described for sleeve 10*f*. The upper portion 70*h* is generally detached from the body 12*h* via the detaching element 80*h* preferably at some time after the floral sleeve 10*h* has been disposed about the pot 62 and floral grouping 82, but may be detached at any time, either before or after the pot 62 and floral grouping 82 are placed within the floral sleeve 10*h*.

The detaching element 80*h* differs from detaching element 80*f* of floral sleeve 10*f* in that detaching element 80*h* has an curved pattern rather than an angular pattern, such that when the upper portion 70*h* is detached from the body 12*h*, the skirt portion 72*h* is left extending from the body 12*h*, in a manner similar to other sleeves described herein.

The upper edges 20*a*-20*d* and 20*g* of sleeves 10*a*-10*d* and 10*g*, respectively, and the detaching elements 80*e*-80*f* and 80*h* of sleeves 10*e*, 10*f* and 10*h*, respectively, are shown as having angular non-linear patterns or curved non-linear patterns. The angular and curved patterns are but two non-linear patterns which may be employed in the construction of the floral sleeves contemplated herein. Other configurations will be readily apparent to those of ordinary skill in the art, for example, those shown in, but not limited to, FIGS. 2A-2F of U.S. Pat. No. 5,829,225, the specification of which is hereby expressly incorporated herein by reference in its entirety.

Figure 15:
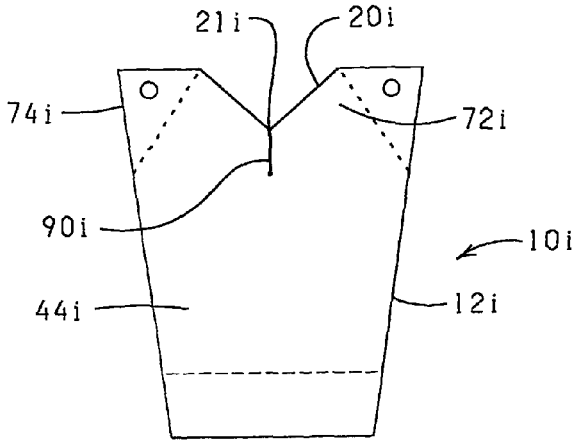
FIG. 15 is an elevational view of another embodiment of the floral sleeve of the presently disclosed and claimed inventive concept(s).

Referring now to FIG. 15, another floral sleeve embodied in the presently disclosed and claimed inventive concept(s) is designated therein by reference numeral 10*i* which is similar to sleeve 10*c*, comprising a body 12*i* having a sidewall 44*i*, a skirt portion 72*i* in the body 12*i*, the skirt portion 72*i* having a skirt upper edge 20*i* and support elements 74*i*. Sleeve 10*i* further comprises a slit 90*i* (which may also comprise perforations or may be entirely severed) which extends from a center point 21*i* in skirt upper edge 20*i* and extends a distance downwardly into body 12*i* for enabling the skirt portion 72*i* to extend further outwardly when the pot 62 is disposed therein. Any of the sleeves described herein may comprise a slit such as slit 90*i* positioned therein.

Figure 16:
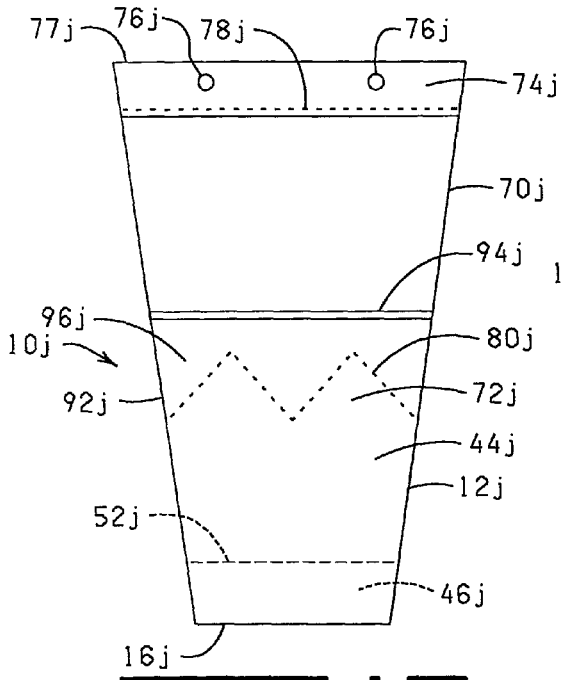
FIG. 16 is an elevational view of another embodiment of the floral sleeve of the presently disclosed and claimed inventive concept(s).

Referring now to FIG. 16, another floral sleeve embodiment of the presently disclosed and claimed inventive concept(s) is designated therein by reference numeral 10*j*. Floral sleeve 10*j* has a lower portion 92*j* and an upper portion 70*j*. The lower portion 92*j* has a body 12*j* and a lower end 16*j*, a sidewall 44*j* in the body 12*j*, a skirt portion 72*j* in the body 12*j*, and a detaching element 80*j* in the lower portion 92*j*. The upper portion 70*j* is attached to the lower portion 92*j* along a horizontal seal 94*j* extending across sleeve 10*j*. Between the horizontal seal 94*j* and the detaching element 80*j* is a medial portion 96*j* which is removed along with the upper portion 70*j* when the upper portion 70*j* is detached.

The upper portion 70*j* and the lower portion 92*j* are constructed of separate webs of material connected along the horizontal seal 94*j*. Preferably, the lower portion 92*j* is constructed of a decorative material and the upper portion 70*j* is constructed of a clear or transparent material. Sleeve 10*j* is similar to sleeve 10*e* in that in sleeve 10*j*, the upper portion 70*j* further comprises a support element 74*j* preferably having apertures 76*j*, an upper edge 77*j* and is detachable via a detaching element 78*j* in a manner similar to sleeve 10*e*. In an alternative embodiment, the sleeve 10*j* may be constructed without a support element 74*j* in a manner similar to sleeve 10*f*. Lower portion 92*j* further comprises in the body 12*j* a gusset 46*j* and an inner gusset fold 52*j*. The apertures 76*j* serve to support the sleeve 10*j* in a manner as described elsewhere herein before, and a plurality of sleeves 10*j* may be connected into a pad as described elsewhere herein before. Sleeve 10*j* is further similar to sleeves 10*e* and 10*f* in that the upper portion 70*j* is preferably sized to surround and enclose the floral grouping 82 when disposed within the opened floral sleeve 10*j*, as described elsewhere herein.

When the upper portion 70*j* and the medial portion 96*j* are removed, the skirt portion 72*j* and body 12*j* provide a covering such as sleeve 10*a* disposed about the pot 62. In an alternative version, no skirt portion is left in the body when an upper portion is removed, and may provide a covering similar to sleeve 10, or may provide a covering having an upper edge which is positioned below the upper end 64 of the pot 62 when the pot 62 is disposed therein.

Figure 17:
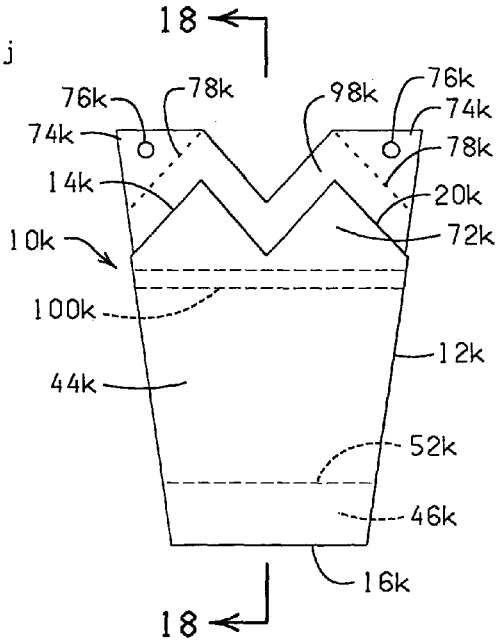
FIG. 17 is an elevational view of another embodiment of the floral sleeve of the presently disclosed and claimed inventive concept(s).
Figure 18:
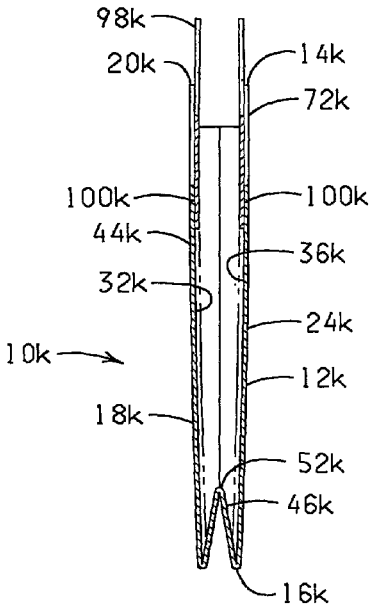
FIG. 18 is a cross-sectional view of the floral sleeve of FIG. 17 taken along line 18-18 thereof.

Referring now to FIGS. 17 and 18, another floral sleeve embodied in the presently disclosed and claimed inventive concept(s) is designated therein by reference numeral 10*k*. Floral sleeve 10*k* is similar to sleeve 10*a* for example, in that it comprises a body 12*k*, and upper end 14*k*, a lower end 16*k*, a sidewall 44*k*, a gusset 46*k* with an inner fold 52*k*, and a skirt portion 72*k* in the body 12*k*. The sleeve 10*k* further comprises a skirt insert 98*k* which extends beyond an upper edge 20*k* of the skirt portion 72*k*. The sleeve 10*k* comprises a pair of support elements 74*k* which extend from the skirt insert 98*k* and which are detachable thereon via detaching, elements 78K. Support elements 74*k* preferably comprise apertures 76*k* for supporting the sleeve 10*k* from a support assembly. The skirt insert 98*k* is preferably attached or laminated via a skirt seal 100*k* to portions of an inner surface 32*k* of a first panel 18*k* and inner surface 36*k* of a second panel 24*k* of the sleeve 10*k* (FIG. 18). Preferably, the skirt insert 98*k* is constructed of a material which is different from the remainder of the material used to construct the body 12*k* and skirt portion 72*k*, or is a material which has a different color or pattern but which is otherwise similar to the material used to construct the body 12*k* and the skirt portion 72*k*.

For example, the body 12*k*, skirt 72*k*, and skirt insert 98*k* may be constructed of metallized film, polymer film, foil, spun bonded, or melt blown material, lace material, fabric, or cellophane, any of which may have different colors, patterns or textures. For example, the body 12*k* and skirt portion 72*k* may be constructed of a metallized polymer film while the skirt insert 98*k* is constructed of a fabric, lace material, or spun bonded material. Other combinations will readily come to the mind of the person of ordinary skill in the art.

Figure 19:
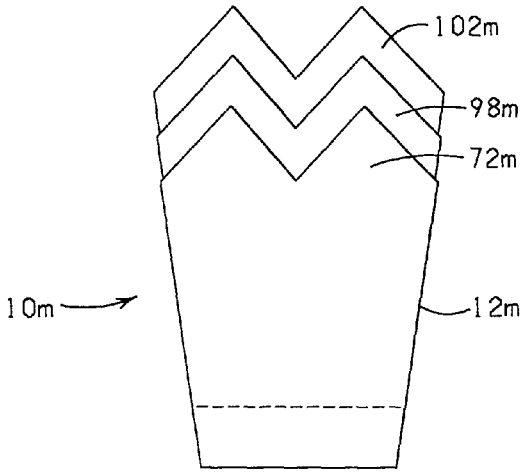
FIG. 19 is an elevational view of another embodiment of the floral sleeve of the presently disclosed and claimed inventive concept(s).

Further, the skirt insert 98*k* may be attached to only one of the first panel 18*k* or the second panel 24*k* of the sleeve 10*k* rather than to both the first panel 18*k* and second panel 24*k* as shown in FIG. 18. Further, any of the sleeves described herein may be constructed to have a skirt insert such as skirt insert 98*k*. For example, sleeve 10 may be constructed to have a skirt insert such as skirt insert 98*k* which is attached near the upper end 14 of the body 12 of sleeve 10. Further, any of the sleeves described herein may have more than one skirt insert such as a shown in FIG. 19 wherein a floral sleeve 10*m* comprises a body 12*m*, a skirt portion 72*m*, a first skirt insert 98*m* and a second skirt insert 102*m*. Any of the sleeves described herein may have two or more skirt inserts as shown for sleeve 10*m*, and, each of the skirt inserts may each be constructed of different materials or materials having different colors or patterns.

It will also be understood by a person of ordinary skill in the art that although the location of the skirt seal 100*k* of the skirt insert 98*k* is shown as being positioned near the upper end 14*k*, the skirt seal 100*k* may in fact be positioned at any location below the upper end 14*k* at any position on the inner surface 32*k* and inner surface 36*k* of the sleeve 10*k* (as shown in phantom in FIG. 18). Further, the skirt insert 98*k* may be attached after the body 12*k* and skirt portion 72*k* of sleeve 10*k* have been formed, or before the material has been formed into the body 12*k* and skirt portion 72*k* by the sleeve forming apparatus. In other words, the separate materials used to construct the body 12*k* and the skirt insert 98*k* may be laminated together while the webs of material are in a flattened, unformed condition. Where used herein, the term "skirt insert" may also be used interchangeably with the term "skirt extension" in that the "skirt insert" may not actually have been "inserted" into the sleeve but may have been "pre-attached" by lamination as described above.

As noted above, the sleeves described herein can be constructed, in whole or in part, from materials including, but not limited to, polymer films, metallized polymer films, natural films, metallized natural films, printed materials of any type, matted materials of any type, cloth, fabric, spun bonded or melt blown materials, paper, tissue, cellophane, biodegradable materials, recyclable materials, metal foils, and combinations and laminations thereof.

As noted above, any of the sleeves described herein may comprise a skirt insert. In those sleeve embodiments having both a skirt insert and an upper portion sized to surround and enclose a floral grouping, and/or for supporting the sleeve from a support assembly or as an attachment within a pad, the upper portion may be attached to the body, to the skirt portion, or to the skirt insert of the sleeve.

Figure 20:
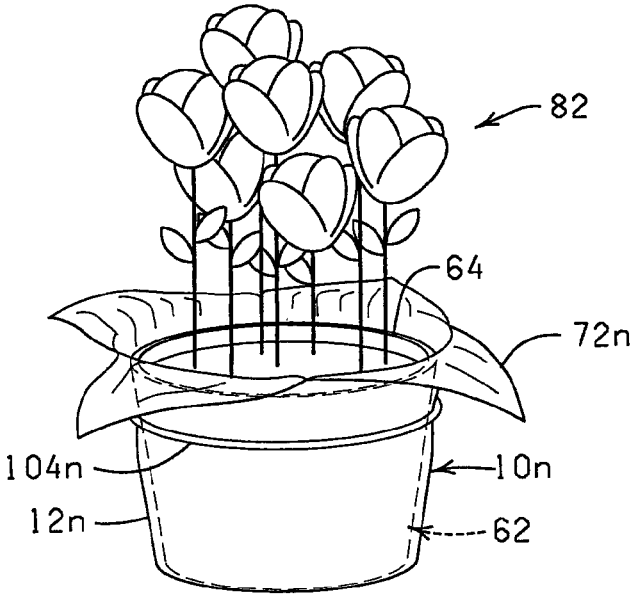
FIG. 20 is a perspective view of a sleeve of the presently disclosed and claimed inventive concept(s) which is secured about a pot via a securing element.
Figure 21:
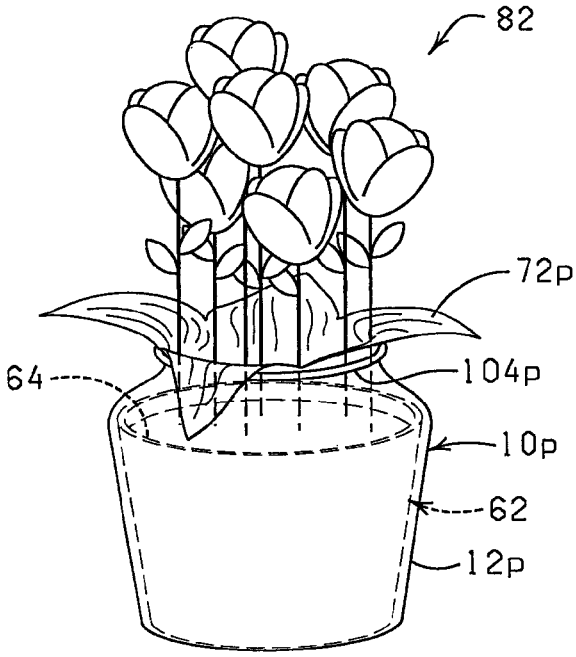
FIG. 21 is a perspective view of a sleeve of the presently disclosed and claimed inventive concept(s) which is secured about a pot via a securing element.

Any of the sleeves described herein may be banded about a potted plant as shown in FIGS. 20 and 21. FIG. 20 shows a sleeve 10*n* having a body 12*n* and a skirt portion 72*n* positioned about the pot 62 and floral grouping 82, the sleeve 10*n* secured about the pot 62 via a securing element 104*n*, wherein the securing element 104*n* is positioned below the upper end 64 of the pot 62. FIG. 21 shows a sleeve 10*p* having a body 12*p* and a skirt portion 72*p* positioned about the pot 62 and floral grouping 82 and secured thereto via a securing element 104*p*, wherein the securing element 104*p* is positioned above the upper end 64 of the pot 62. More than one securing element 104*n* or 104*p* can be used. The securing elements 104*n* and 104*p* preferably are banding elements such as, elastic bands, plastic bands, strings, ribbons, ties, tapes, labels, wires, collars, stribbons, rubber bands, but may also be adhesive or cohesive materials, barbs on the pot 62, pins, clips, springs, staples, magnets, or any other binding or securing materials known in the art.

Any of the sleeves described herein in any embodiments can be used to contain floral groupings or plants with or without pots, and with or without a growing medium or support medium such as floral foam. When used with a growing medium, they may be used to cultivate a botanical item. The sleeves described herein may be used as flexible vases to contain floral groupings and preferably are waterproof or leak resistant. The sleeves described herein may be used as covers for jardinieres, for pots or for vases, or any type of floral grouping or floral container. Any of the sleeves described herein may be equipped with reservoirs, pouches or packets for containing moisture, fertilizers, growing media, or other items useful or beneficial for growth or presentation of floral grouping or other botanical items. The reservoirs, pouches or packets may be attached to an inner portion of the sleeve.

Any of the sleeves described herein can be constructed using multiple webs of material which are laminated or attached together to achieve contrasting effects in the completed sleeve, produced for example by using webs of materials having different patterns, colors, or textures.

For example, a 20"×20" sheet of metallized film may be used in conjunction with a 24"×24" sheet of spun bonded material; or, a 20"×20" sheet of metallized material may be used with a 24"×24" sheet of lace material and with a 28"×28" sheet of spun bonded material.

Further, by laminating a narrower web and a wider web, centering the narrower web on the wider web. Any number of consecutive webs can be used in the process. These webs need not be laminated but could be left un-laminated and held in place only by the seal on the sleeve. However, for ease of processing, it may be preferable in some instances and with some equipment to laminate either by overall adhesively laminating or spot laminating or strip laminating the material. It may be preferable to leave certain portions of the material un-laminated so as to provide the appearance of separate sheets.

Using the lamination technique or using a sleeve made without lamination but using multiple materials, it is not necessary to use an entire standard web. For example, it is possible to take a 20" web as the base web and to laminate two additional webs of 3" each, for example, overlapping 1" of each of the two additional 3" strips over the base web and laminating them at that point or simply feeding them into the machine at that point and forming them. Or, entirely overlapping webs could be used, that is, one 20" web is centered on a 24" web. It could be laminated or un-laminated as it passes through the sleeve forming machine.

Any of the flexible floral sleeves contemplated herein may also be equipped with drainage elements (e.g., one or more holes) in the bodies 10-10*h* thereof or ventilation holes (not shown) in the bodies 10-10*p* or upper portions 70*e*, 74*f* or 74*h*, for example, or can be made from permeable or impermeable materials.

The materials from which the flexible floral sleeves 10-10*p* are constructed preferably have a thickness in a range from about 0.1 mil to about 30 mil. Often, the thicknesses of the floral sleeves 10-10*p* are in a range from about 0.5 mil to about 10 mil or preferably, in a range from about 1.0 mil to about 5 mil. Preferably, the floral sleeves 10-10*p* are constructed from a material which is flexible, semi-rigid, rigid, or any combination thereof. The floral sleeves 10-10*p* may be constructed of a single layer of material or a plurality of layers of the same or different types of materials. Any thickness of the material may be utilized as long as the material functions in accordance with the presently disclosed and claimed inventive concept(s) as described herein. The layers of material comprising the flexible floral sleeves may be connected together or laminated or may be separate layers. Such materials used to construct the floral sleeves are described in U.S. Pat. No. 5,111,637, which is hereby expressly incorporated herein by reference. Any thickness of material may be utilized in accordance with the presently disclosed and claimed inventive concept(s) as long as the floral sleeves 10-10*p* may be formed as described herein, and as long as the floral sleeves 10-10*p* may contain at least a portion of a flower pot, potted plant, growing medium or floral grouping, as described herein. Additionally, an insulating material such as bubble film, preferable as one of two or more layers, can be utilized in order to provide additional protection for the item, such as the floral grouping, contained therein.

As noted above, the floral sleeves 10-10*p* are constructed from any suitable material that is capable of being formed into a floral sleeve as contemplated herein and wrapped about a flower pot and a floral grouping disposed therein. Preferably, the material comprises treated or untreated paper, metal foil, polymeric film, non-polymeric film, wove, or nonwoven fabric, synthetic or natural fabric, cardboard, fiber, cloth, burlap, or laminations or combinations thereof.

The term "polymeric film" when used herein means a film made of a synthetic polymer such as a polypropylene or a naturally occurring polymer such as cellophane. A polymeric film is relatively strong and not as subject to tearing (substantially non-tearable), as might be the case with paper or foil.

In one embodiment, the floral sleeves 10-10*p* may be constructed from sheets comprising two polypropylene films. The material comprising the flexible floral sleeves 10-10*p* may be connected together or laminated or may be separate layers. In an alternative embodiment, the flexible floral sleeves 10-10*p* may be constructed from only one sheet of the polypropylene film.

The materials comprising the floral sleeves 10-10*p* may vary in color and as described herein consists of designs or decorative patterns which are printed, etched, and/or embossed thereon using inks or other printing materials. An example of an ink which may be applied to the surface of the material is described in U.S. Pat. No. 5,147,706, which is hereby expressly incorporated herein by reference.

In addition, the material may have various colorings, coatings, flocking and/or metallic finishes, or other decorative surface ornamentation applied separately or simultaneously or may be characterized totally or partially by pearlescent, translucent, transparent, iridescent, neon, or the like, qualities. The material may further comprise, or have applied thereto, one or more scents. Each of the above-named characteristics may occur alone or in combination and may be applied to the upper and/or lower surface of the material comprising the floral sleeves 10-10*p*. Moreover, portions of the material used in constructing the floral sleeves 10-10*p* may vary in the combination of such characteristics. The material utilized for the floral sleeves 10-10*p* may be opaque, translucent, transparent, or partially clear or tinted transparent.

The term "floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping. The floral grouping comprises a bloom or foliage portion and a stem portion. Further, the floral grouping may comprise a growing potted plant having a root portion (not shown) as well. However, it will be appreciated that the floral grouping may consist of only a single bloom or only foliage, or a botanical item (not shown), or a propagule (not shown). The term "floral grouping" may be used interchangeably herein with both the terms "floral arrangement" and "potted plant". The term "floral grouping" may also be used interchangeably herein with the terms "botanical item" and/or "propagule".

The term "growing medium" when used herein means any liquid, solid or gaseous material used for plant growth or for the cultivation of propagules, including organic and inorganic materials such as soil, humus, perlite, vermiculite, sand, water, foam, and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet of floral grouping. The term "propagule" when used herein means any structure capable of being propagated or acting as an agent of reproduction including seeds, shoots, stems, runners, tubers, plants, leaves, roots, or spores.

In accordance with the presently disclosed and claimed inventive concept(s) a bonding material may optionally be disposed on a portion of any of the floral sleeves 10-10*p* described herein to attach each floral sleeve 10-10*p* to a flower pot 62 having a floral grouping 82 therein when such a flower pot 62 is disposed within the floral sleeve 10-10*p* or to assist in closing or sealing the upper portion 70*e*, 70*f* or 70*h* of the floral sleeve 10*e*, 10*f* or 10*h* or in adhering the floral sleeve 10-10*p* to the flower pot 62 after the flower pot 62 has been disposed therein. Examples of how a bonding material may be disposed on the floral sleeve 10-10*p* are shown in U.S. Pat. No. 5,493,809 and in U.S. Pat. No. 5,625,979, each of which is hereby expressly incorporated herein by reference in its entirety.

The term "detaching element" 78*c*, 78*d*, 78*e*, 78*g*, 80*e*, 80*f* or 80*h*, for example, when used generally herein, means any element or device such as, but not limited to, perforations, tear strips, zippers, and any other devices or elements of this nature known in the art, or any combination thereof, which enable the tearing away or detachment of one object from another. Therefore, while perforations are shown and described in detail herein, it will be understood that tear strips, zippers, or any other "detaching element" known in the art, or any combination thereof, could be substituted therefore and/or used therewith.

The upper portions 70*e*, 70*f*, 70*h* and 70*j* of the floral sleeves 10*e*, 10*f*, 10*h* and 10*j*, respectively may also have an additional vertical detaching element comprising a plurality of vertical perforations (not shown) for facilitating removal of the upper portion 70*e*, 70*f*, 70*h* and 70*j* and which are disposed more or less vertically therein.

It will be understood by a person of ordinary skill in the art that equipment and devices for forming flexible floral sleeves are commercially available, and are well known to a person of ordinary skill in the art. Therefore, further detailed discussion of the construction of the sleeves described herein is not deemed necessary.

However, briefly, the flexible floral sleeves 10-10*p* described herein may be formed by intermittently advancing, one or two webs preformed in the form of a tube, or a single web folded double, indenting the lower end to form a folded pouch portion for forming the gusset, and sealing the longitudinal sides of the two facing panels and the sides of the gussets, then cutting the floral sleeve 10-10*p* thus formed from the webs or web. Machines which can form floral sleeves 10-10*p* from such single webs or tubes are well within the knowledge of one of ordinary skill in the art.

The term "flower pot" or "pot" 62 as used herein refers to any type of container used for holding a floral grouping or plant, including vases. Examples of pots, used in accordance with the presently disclosed and claimed inventive concept(s) include, but are not limited to, clay pots, foam pots, wooden pots, plastic pots, pots made from natural and/or synthetic fibers, and/or any combination thereof. The flower pot 62 is adapted to receive a floral grouping 82 in the retaining space thereof. The floral grouping 82 may be disposed within the flower pot 62 along with a suitable growing medium described elsewhere herein, or other retaining medium, such as floral foam. It will also be understood that a floral grouping, botanical item or propagule and any appropriate growing medium or other retaining medium, may be disposed in the floral sleeve 10-10*p* without the flower pot 62 for displaying, transporting or cultivating the item disposed within the floral sleeve 10-10*p*.

Preferably the floral sleeve 10-10*p* is sized to contain and conform to one of a variety of standard sizes of pots known to those of ordinary skill in the art, such as 3½ inch, 4 inch, 4½ inch, 5 inch, 5½ inch, 6 inch, 6½ inch, 7 inch, 7½ inch, 8 inch and 8½ inch pots or pots that are larger than, smaller than, or intermediate between such pot sizes.

Although not shown herein, any of the sleeves 10-10*p* described herein may be used as a container for a growing medium and a floral grouping 82 wherein the floral grouping 82 is disposed within the growing medium without using a pot 62. In a preferred version, at least a portion of the sleeve 10-10*p* is constructed of a material resistant or impermeable to leakage, while the detachable upper portion, if present, is preferably constructed of a thinner transparent material.

Any of the floral sleeves described or contemplated herein, such as floral sleeves 10-10*p* may be secured about the pot 62 by a securing element as described above or by forming a crimped portion which is held in a crimped shape by an adhesive or cohesive bonding material. The securing element or crimped portion could be positioned either above or below the upper end 64 of the pot 62 when the pot 62 is disposed within the floral sleeve 10-10*p*.

It should be further noted that various features of the versions of the presently disclosed and claimed inventive concept(s) such as closure bonding areas, support apertures, handles or handle apertures, additional perforations, drainage holes, ventilation holes, combinations of material may be used alone or in combination as elements of any of the embodiments described above herein.

Changes may be made in the construction and the operation of the various components, elements and assemblies described herein or in the steps or the sequence of steps of the methods described herein without departing from the spirit and scope of the presently disclosed and claimed inventive concept(s) as defined in the following claims.

What is claimed is:

1. A method of covering a pot or floral grouping, comprising:

opening a preformed floral sleeve from a flattened condition to an opened condition to expose an interior space of a body thereof, the preformed floral sleeve comprising:

a body having an upper end, a closed lower end, and a sidewall comprising an outer peripheral surface and an inner peripheral surface, wherein the inner peripheral surface surrounds an interior space when the preformed floral sleeve is in an opened condition, wherein the body is tapered from the upper end to the closed lower end thereof, the sidewall comprising a first panel and a second panel that are connected to one another along at least two side edges, the body having a tubular shape in the opened condition of the preformed floral sleeve, and the first and second panels being positioned flatwise upon each other in the flattened condition of the preformed floral sleeve; and an insert or extension bondingly attached to at least a portion of at least one of the first and second panels, thereby attaching the insert or extension to at least a portion of the inner peripheral surface of the body of the preformed floral sleeve, the insert or extension having a lower end and an upper end, wherein at least a portion of the lower end of the insert or extension is disposed below the upper end of the body of the preformed floral sleeve and substantially above the lower end of the body of the preformed floral sleeve, the insert or extension comprising a facing portion that is superposed upon the portion of the inner peripheral surface of the body of the preformed floral sleeve wherein the insert or extension is bondingly attached along only a portion of the facing portion and whereby a majority of the facing portion is left unattached to the inner peripheral surface of the body of the preformed floral sleeve, and wherein the upper end of the body of the preformed floral sleeve is unattached to the insert or extension; and disposing a pot or floral grouping into at least a portion of the interior space of the body of the preformed floral sleeve, wherein at least a portion of the insert or extension is visible when the pot or floral grouping is disposed into the preformed floral sleeve, and wherein the preformed floral sleeve has an appearance of being constructed of at least two separate, unconnected materials.

2. The method of claim 1, wherein at least a portion of the upper end of the insert or extension extends above an upper end of the body of the preformed floral sleeve.

3. The method of claim 1, wherein the preformed floral sleeve further comprises a skirt portion having an upper edge, wherein the skirt portion extends from the upper end of the body, and wherein at least a portion of the skirt portion extends above an upper end of the pot after the pot is disposed into the interior space of the body of the preformed floral sleeve.

4. The method of claim 3, wherein the preformed floral sleeve has a slit or line of perforations which extends vertically from a center point in the upper edge of the skirt portion a distance downwardly into the body of the preformed floral sleeve.

5. The method of claim 3, wherein the upper edge of the skirt portion has a non-linear pattern.

6. The method of claim 3, wherein the upper edge of the skirt portion extends above the upper end of the insert or extension.

7. The method of claim 3, wherein the preformed floral sleeve further comprises an upper portion attached to at least one of the upper end of the body of the preformed floral sleeve and the upper edge of the skirt portion of the preformed floral sleeve.

8. The method of claim 1, wherein the preformed floral sleeve further comprises an upper portion attached to the upper end of the body of the preformed floral sleeve.

9. The method of claim 1, wherein the insert or extension of the preformed floral sleeve is constructed of a material which is different from a material used to construct the body of the floral sleeve.

10. The method of claim 1, further comprising the additional step of securing the preformed floral sleeve about the pot or floral grouping by disposing a securing element about the preformed floral sleeve after the floral sleeve has been disposed about the pot, wherein the securing element is selected from the group consisting of elastic bands, plastic bands, strings, labels, tapes, ribbons, ties, wires, stribbons, rubber bands, barbs, collars, staples, and clips, and combinations thereof.

11. The method of claim 10, wherein the securing element is placed above an upper end of the pot or floral grouping.

12. The method of claim 10, wherein the securing element is placed below an upper end of the pot or floral grouping.

13. The method of claim 1, wherein the preformed floral sleeve further comprises a second insert or extension bondingly attached to at least a portion of at least one of the inner peripheral surface of the body and the first insert or extension, the second insert or extension having a lower end and an upper end, wherein at least a portion of the lower end of the second insert or extension is disposed below the upper end of the body of the preformed floral sleeve and substantially above the lower end of the body of the preformed floral sleeve, the second insert or extension comprising a facing portion that is superposed upon the portion of at least one of the inner peripheral surface of the body of the preformed floral sleeve and the first insert or extension wherein the second insert or extension is bondingly attached along only a portion of the facing portion and whereby a majority of the facing portion is left unattached, and wherein the upper end of the body of the preformed floral sleeve is unattached to the second insert or extension.

14. The method of claim 13, wherein the upper end of the second insert or extension extends above the upper end of the first insert or extension.

15. The method of claim 13, wherein the upper end of the first insert or extension extends above the upper end of the second insert or extension.

16. The method of claim 1, wherein the preformed floral sleeve is constructed of a material selected from the group consisting of polymer films, metallized polymer films, natural films, metallized natural films, cloth, fabric, spun bonded materials, melt blown materials, paper, tissue, cellophane, biodegradable materials, recyclable materials, metal foils, and combinations and laminations thereof.

17. The method of claim 1, wherein at least a portion of the body of the preformed floral sleeve is provided with a decorative pattern thereon.

18. The method of claim 1, wherein at least a portion of the insert or extension is provided with a decorative pattern thereon.

19. The method of claim 1, wherein at least a portion of the body of the preformed floral sleeve and at least a portion of the insert or extension are provided with decorative patterns thereon, and wherein the decorative pattern present on the body of the preformed floral sleeve is different from the decorative pattern present on the insert or extension.

20. The method of claim 1, wherein the insert or extension is connected to at least a portion of the first panel and at least a portion of the second panel.

21. The method of claim 1, wherein the insert or extension is connected to only one of the first and second panels.

* * * * *

UNITED STATES PATENT AND TRADEMARK OFFICE

CERTIFICATE OF CORRECTION

PATENT NO. : 8,726,569 B2
APPLICATION NO. : 13/678297
DATED : May 20, 2014
INVENTOR(S) : Donald E. Weder et al.

It is certified that error appears in the above-identified patent and that said Letters Patent is hereby corrected as shown below:

On the Title Page:

Under Item (71) Applicant: After "U/T/A," insert -- dated Dec. 8, 1995 --

Signed and Sealed this
Twenty-second Day of July, 2014

Michelle K. Lee

Michelle K. Lee
*Deputy Director of the United States Patent and Trademark Office*